US007674174B2

(12) United States Patent
Marks et al.

(10) Patent No.: US 7,674,174 B2
(45) Date of Patent: Mar. 9, 2010

(54) GAMING DEVICE HAVING ONE OR MORE PAYLINE AWARDS CALCULATED AS A FUNCTION OF THE TOTAL WAGER

(75) Inventors: Daniel M. Marks, Washington, DC (US); Anthony M. Singer, Ringwood, NJ (US); Howard M. Marks, Scarsdale, NY (US)

(73) Assignee: IGT, Reno, NV (US)

( * ) Notice: Subject to any disclaimer, the term of this patent is extended or adjusted under 35 U.S.C. 154(b) by 386 days.

(21) Appl. No.: 11/253,217

(22) Filed: Oct. 18, 2005

(65) Prior Publication Data

US 2006/0084497 A1 Apr. 20, 2006

Related U.S. Application Data

(60) Provisional application No. 60/619,675, filed on Oct. 18, 2004, provisional application No. 60/705,374, filed on Aug. 4, 2005.

(51) Int. Cl.
*A63F 9/24* (2006.01)

(52) U.S. Cl. ..... 463/20; 463/16; 463/17; 463/18; 463/19; 463/25

(58) Field of Classification Search ..... 463/16–20, 463/25
See application file for complete search history.

(56) References Cited

U.S. PATENT DOCUMENTS

| | | | |
|---|---|---|---|
| 4,448,419 | A | 5/1984 | Telnaes |
| 4,624,459 | A | 11/1986 | Kaufman |
| 4,669,731 | A | 6/1987 | Clarke |
| 4,695,053 | A | 9/1987 | Vazquez, Jr. et al. |
| 4,721,307 | A | 1/1988 | Okada |
| 4,838,552 | A | 6/1989 | Hagiwara |
| 4,991,848 | A | 2/1991 | Greenwood et al. |
| 5,116,055 | A | 5/1992 | Tracy |
| RE34,244 | E | 5/1993 | Hagiwara |
| 5,209,479 | A | 5/1993 | Nagao et al. |
| 5,344,144 | A | 9/1994 | Canon |
| 5,393,061 | A | 2/1995 | Manship et al. |
| 5,395,111 | A | 3/1995 | Inoue |
| 5,397,125 | A | 3/1995 | Adams |

(Continued)

FOREIGN PATENT DOCUMENTS

| | | | |
|---|---|---|---|
| AU | 199716432 | B2 | 9/1997 |

(Continued)

OTHER PUBLICATIONS

Vcjnoska, Jill, "Georgia Powerbal; Confusion or cash awaits game players", The Atlanta Journal and Constitution, Sep. 2, 1995, Section: Local News, p. 2C.*

(Continued)

*Primary Examiner*—Corbett B Coburn
*Assistant Examiner*—David Duffy
(74) *Attorney, Agent, or Firm*—K&L Gates LLP

(57) ABSTRACT

A gaming device which includes a variety of methods to calculate one or more line pay awards as a function of the total amount wagered upon the game. In one embodiment, the gaming device multiplies the award for the most valuable symbol combination appearing on any payline by the total amount wagered upon the game.

13 Claims, 9 Drawing Sheets

U.S. PATENT DOCUMENTS 5,437,451 A 8/1995 Fulton
5,449,173 A 9/1995 Thomas et al.
5,489,101 A 2/1996 Moody
5,511,781 A 4/1996 Wood et al.
5,531,448 A 7/1996 Moody
5,580,053 A 12/1996 Crouch
5,584,764 A 12/1996 Inoue
5,611,535 A 3/1997 Tiberio
5,645,485 A 7/1997 Clapper, Jr.
5,732,950 A 3/1998 Moody
5,752,881 A 5/1998 Inoue
5,769,716 A 6/1998 Saffari et al.
5,816,916 A 10/1998 Moody
5,817,172 A 10/1998 Yamada et al.
5,823,873 A 10/1998 Moody
5,823,874 A 10/1998 Adams
5,833,537 A 11/1998 Barrie
5,848,932 A 12/1998 Adams
5,882,261 A 3/1999 Adams
5,890,962 A 4/1999 Takemoto
5,910,048 A 6/1999 Feinberg
5,954,335 A 9/1999 Moody
5,967,893 A 10/1999 Lawrence et al.
5,984,781 A 11/1999 Sunaga
5,984,782 A 11/1999 Inoue
5,993,316 A 11/1999 Coyle et al.
5,997,401 A 12/1999 Crawford
6,004,207 A 12/1999 Wilson, Jr. et al.
6,007,066 A 12/1999 Moody
6,012,983 A 1/2000 Walker et al.
6,027,115 A 2/2000 Griswold et al.
6,033,307 A 3/2000 Vancura
6,056,642 A 5/2000 Bennett
6,059,289 A 5/2000 Vancura
6,062,980 A 5/2000 Luciano
6,089,978 A 7/2000 Adams
6,093,102 A 7/2000 Bennett
6,095,921 A 8/2000 Walker et al.
6,098,985 A 8/2000 Moody
6,102,400 A 8/2000 Scott et al.
6,110,041 A 8/2000 Walker et al.
6,113,098 A 9/2000 Adams
6,120,377 A 9/2000 McGinnis, Sr. et al.
6,120,378 A 9/2000 Moody et al.
6,126,542 A 10/2000 Fier
6,155,925 A 12/2000 Giobbi et al.
6,158,741 A 12/2000 Koelling
6,159,095 A 12/2000 Frohm et al.
6,159,097 A 12/2000 Gura
6,159,098 A 12/2000 Slomiany et al.
6,165,070 A 12/2000 Nolte et al.
6,168,522 B1 1/2001 Walker et al.
6,168,523 B1 1/2001 Piechowiak et al.
6,174,233 B1 1/2001 Sunaga et al.
6,174,235 B1 1/2001 Walker et al.
6,186,894 B1 2/2001 Mayeroff
6,190,254 B1 2/2001 Bennett
6,200,217 B1 3/2001 Osawa
6,203,429 B1 3/2001 Demar et al.
6,210,277 B1 4/2001 Stefan
6,213,877 B1 4/2001 Walker et al.
6,220,959 B1 4/2001 Holmes, Jr. et al.
6,224,482 B1 5/2001 Bennett
6,224,483 B1 5/2001 Mayeroff
6,227,969 B1 5/2001 Yoseloff
6,227,971 B1 5/2001 Weiss
6,231,442 B1 5/2001 Mayeroff
6,231,445 B1 5/2001 Acres
6,234,897 B1 5/2001 Frohm et al.
6,238,287 B1 5/2001 Komori et al.
6,241,607 B1 6/2001 Payne et al.
6,244,957 B1 6/2001 Walker et al.
6,254,482 B1 7/2001 Walker et al.
6,261,178 B1 7/2001 Bennett
6,270,409 B1 8/2001 Shuster
6,270,411 B1 8/2001 Gura et al.
6,299,165 B1 10/2001 Nagano
6,302,791 B1 10/2001 Frohm et al.
6,309,299 B1 10/2001 Weiss
6,311,976 B1 11/2001 Yoseloff et al.
6,312,331 B1 11/2001 Tamaki
6,315,660 B1 11/2001 DeMar et al.
6,315,662 B1 11/2001 Jorasch et al.
6,328,649 B1 12/2001 Randall et al.
6,334,814 B1 1/2002 Adams
6,336,860 B1 1/2002 Webb
6,336,862 B1 1/2002 Byrne
6,358,147 B1 3/2002 Jaffe et al.
6,364,766 B1 4/2002 Anderson et al.
6,413,162 B1 7/2002 Baerlocher et al.
6,419,579 B1 7/2002 Bennett
6,439,993 B1 8/2002 O'Halloran
6,471,208 B2 10/2002 Yoseloff et al.
6,491,584 B2 12/2002 Graham et al.
6,517,432 B1 2/2003 Jaffe
6,533,279 B2 3/2003 Moody et al.
6,547,242 B1 4/2003 Sugiyama et al.
6,551,187 B1 4/2003 Jaffe
6,558,253 B1 5/2003 DeSimone et al.
6,561,900 B1 5/2003 Baerlocher et al.
6,604,740 B1 * 8/2003 Singer et al. ..... 273/292
6,604,999 B2 8/2003 Ainsworth
6,605,002 B2 8/2003 Baerlocher
6,612,927 B1 9/2003 Slomiany et al.
6,616,142 B2 9/2003 Adams
6,638,164 B2 10/2003 Randall et al.
6,695,696 B1 2/2004 Kaminkow
6,729,621 B2 5/2004 Moody
6,802,773 B2 10/2004 Moody
6,852,028 B2 * 2/2005 Vancura ..... 463/16
7,029,395 B1 4/2006 Baerlocher
2002/0094857 A1 7/2002 Meyer
2003/0045345 A1 3/2003 Berman
2003/0054875 A1 * 3/2003 Marks et al. ..... 463/20
2003/0060266 A1 3/2003 Baerlocher
2003/0085514 A1 5/2003 Yoseloff et al.
2003/0216165 A1 * 11/2003 Singer et al. ..... 463/20
2004/0009803 A1 1/2004 Bennett et al.
2004/0023714 A1 2/2004 Asdale
2004/0072612 A1 * 4/2004 Rodgers et al. ..... 463/20
2005/0054429 A1 3/2005 Baerlocher et al.
2005/0060050 A1 3/2005 Baerlocher
2005/0096123 A1 5/2005 Cregan et al.
2006/0030399 A1 2/2006 Baerlocher
2006/0073879 A1 4/2006 Baerlocher et al.

FOREIGN PATENT DOCUMENTS

AU 199717601 B2 9/1997
AU A-50327/96 10/1997
AU A-63553/98 10/1998
DE 3700861 A1 7/1988
DE 4014477 A1 7/1991
EP 0 060 019 9/1982
EP 0 410 789 7/1990
EP 0 688 002 A1 12/1995
EP 0 798 676 A1 10/1997
EP 0 874 337 A1 10/1998
EP 0 926 645 A2 6/1999
EP 0 944 030 A2 9/1999
EP 0 945 837 A2 9/1999
EP 0 984 408 A2 3/2000
EP 0 984 409 A2 3/2000
GB 2 083 936 A 3/1982

| | | | |
|---|---|---|---|
| GB | 2 092 797 | B | 8/1982 |
| GB | 2 144 644 | A | 3/1985 |
| GB | 2 170 636 | A | 2/1986 |
| GB | 2 226 907 | A | 7/1990 |
| GB | 2 328 311 | A | 2/1999 |
| WO | WO 85/00910 | | 2/1985 |
| WO | WO 97/32285 | | 9/1997 |
| WO | WO 00/12186 | | 3/2000 |
| WO | WO 00/66235 | | 11/2000 |
| WO | WO 00/76606 | A1 | 12/2000 |
| WO | WO 01/87441 | | 11/2001 |
| WO | WO 03/026758 | A1 | 4/2003 |

OTHER PUBLICATIONS

Black Swan advertisement by IGT, published prior to 2001.
Bonus Times Article written by Strictly Slots, published in Jul. 2000.
Enchanted Unicorn Advertisement, written by IGT, published in 2001.
Leopard Spots™ (website) written by www.igt.com, printed Mar. 21, 2001.
Mega Multiplier® (website) written by www.wmsgaming.com, printed May 22, 2001.
Penguin Pays Advertisement, written by Aristocrat Incorporated, published in 1998.
Polly & Roger Brochure written by VLC, Inc, published in 2000, on or before Dec. thereof.
Reel MAGIC™ Gaming Machine Description, written by IGT, available in 1986.
Slot Machines Article, written by Marshall Fey, published 1983, 1989, 1991, 1994 and 1997.
Super Times Pay Poker advertisement written by www.actiongaming.com printed Mar. 24, 2005.
Take Your Pick Advertisement written by IGT/Anchor Gaming, published in 1999, on or before Dec. thereof.
Take Your Pick Article written by Strictly Slots, published in Mar. 2001.
Totem Pole Advertisement written by IGT, published in 1997.
Vision Series™ /Good Times™ Brochure written by IGT, published in 1999, on or before Dec. thereof.
Winning Streak Web Site Description written by WMS Gaming Inc. (web site), printed on Mar. 21, 2001.
X Factor Brochure written by WMS Gaming, Inc., published in 1998, on or before Dec. thereof.
Office Action dated Oct. 11, 2007 for U.S. Appl. No. 11/251,025.

* cited by examiner

GAMING DEVICE HAVING ONE OR MORE PAYLINE AWARDS CALCULATED AS A FUNCTION OF THE TOTAL WAGER

PRIORITY CLAIM

This application is a non-provisional patent application that claims priority to and the benefit of U.S. Provisional Patent Application Ser. No. 60/619,675 filed on Oct. 18, 2004, and U.S. Provisional Patent Application Ser. No. 60/705,374 filed on Aug. 4, 2005, the entire contents of which are incorporated herein by reference.

CROSS REFERENCE TO RELATED APPLICATIONS

This application relates to the following co-pending commonly owned patent applications: "METHOD OF PLAYING A SLOT MACHINE GAME WITH ONE OR MORE LINE PAY AWARDS CALCULATED AS A FUNCTION OF THE TOTAL WAGER," Ser. No. 11/251,025.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

FIELD OF INVENTION

In general, the present invention relates to methods of calculating line pay awards in a multi-payline slot machine game. More particularly, the present invention calculates one or more line pay awards as a function of the total wager.

BACKGROUND OF THE INVENTION

Gaming device manufacturers strive to make wagering gaming devices that provide as much enjoyment, entertainment and excitement as possible for players. Providing interesting and exciting primary or base games and secondary or bonus games in which a player has an opportunity to win potentially large awards or credits is one way to enhance player enjoyment and excitement. Certain known gaming devices use devices such as reels or wheels to enhance the attraction of the gaming machines to players and also to enhance the player's game playing experience. These devices enable a player to see physical movements of a game, a portion of a game, or a functional game event or element which increases the player's enjoyment of the game.

In one slot gaming device, the gaming device includes a plurality of reels and one or more paylines. Such gaming devices include any suitable number of reels, such as three to five reels, which each display any suitable number of symbols per reel, such as three symbols per reel. In these gaming devices, the player initiates the spinning of the reels by making one or more wagers on one or more paylines. Such gaming devices may have one, three, five, nine, fifteen, twenty-five or any other suitable number of paylines which are horizontal, vertical, diagonal or any combination thereof. The player wagers on a player selected number or combination of paylines, such as one, two, three, five, ten or fifteen paylines and the reels are activated to spin.

After the reels spin to generate a plurality of symbols, the gaming device analyzes the generated symbols to determine if the gaming device has randomly generated a winning symbol or winning symbol combination on one or more of the wagered on paylines. A conventional line pay award is calculated by multiplying the award value for the winning symbol combination by the amount wagered upon the payline upon which the winning symbol combination appears. Such calculated awards are provided to the player.

New methods of playing slot machines, therefore, are required to provide players, casinos, and manufacturers with uniquely entertaining slot machine games, including new ways to calculate line pay awards.

SUMMARY OF THE INVENTION

The present invention includes a variety of methods to calculate one or more line pay awards as a function of the total amount wagered upon the game.

In one embodiment, the appearance or generation of a trigger symbol in the third column of the symbol initiates a Total Bet Multiplier feature. In this embodiment, the gaming device multiplies the award for the most valuable winning symbol combination appearing on a payline by the total bet. It should be appreciated that this feature can be triggered in any suitable manner or based on any suitable event, such as an event based on one or more symbol combinations, an event based on the player's wager, a predetermined event, a randomly determined event, an event determined based on the player's status (such as determined through a player tracking system), or an event determined based on time.

In one embodiment, upon the appearance of a trigger symbol, the game determines the values of winning symbol combinations appearing on each payline, whether or not the player has wagered upon the payline, and then issues an award as follows:

(1) if only one winning symbol combination appears, the value is multiplied by the total bet to calculate the award issued to the player;

(2) if two or more winning symbol combinations appear with differing values, the highest value is multiplied by the total bet to calculate the award issued to the player;

(3) if two or more winning symbol combinations appear with the same highest value, only one value is multiplied by the total bet to calculate the award issued to the player; and (4) if no winning symbol combinations appear, no award issues to the player.

In addition to initiating the Total Bet Multiplier feature, in one embodiment, the trigger symbol also acts as a wildcard symbol to help form winning symbol combinations. A winning symbol combination using a trigger symbol is treated the same as any other symbol combination for the purposes of the Total Bet Multiplier feature.

Other objects, features and advantages will be apparent from the following detailed disclosure, taken in conjunction with the accompanying sheets of drawings, wherein like numerals refer to like parts, elements, components, steps and processes.

DETAILED DESCRIPTION

Figure 1:
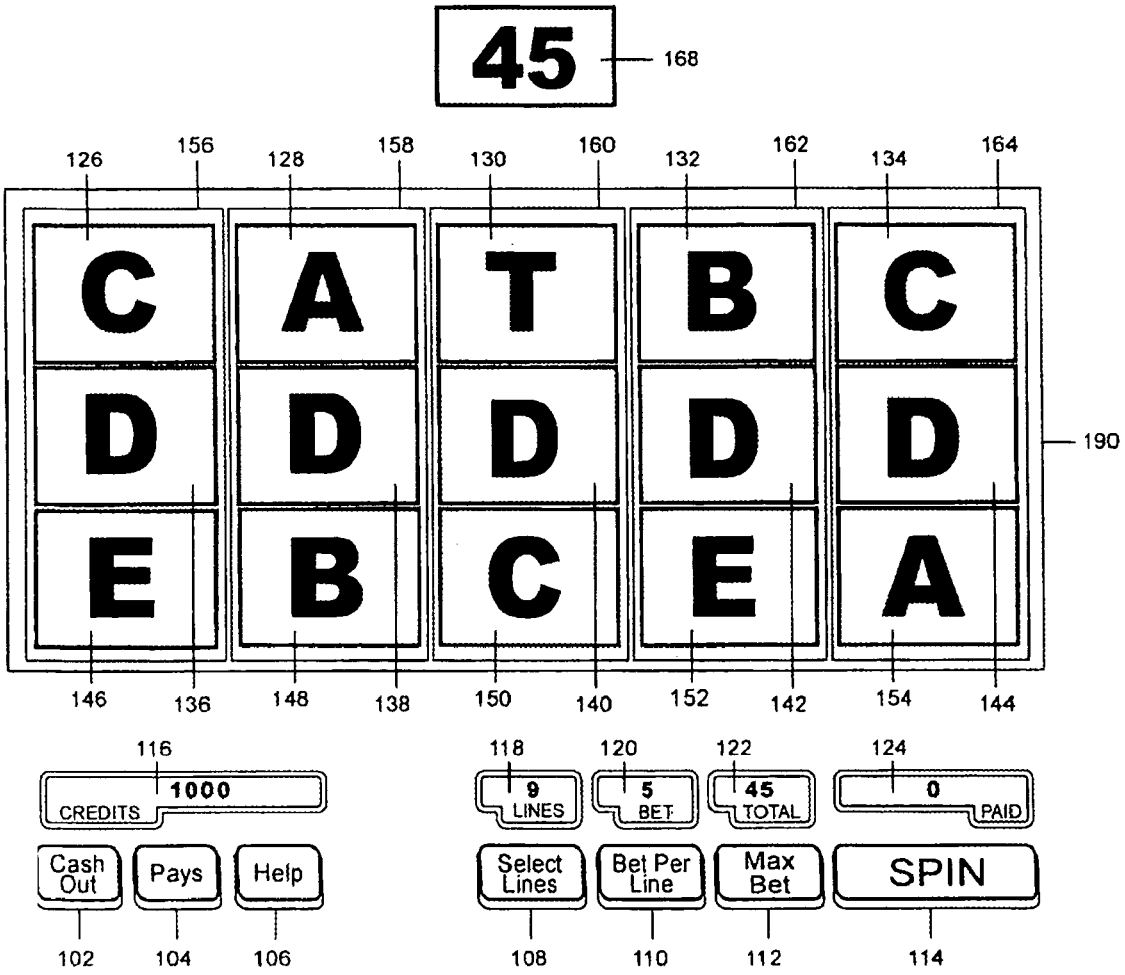
FIG. 1 is a elevation view of one of the display devices of the gaming device illustrating a total bet multiplier value above the symbol matrix and a winning symbol combination on a payline.

In one embodiment, to play the Total Bet Multiplier embodiment, the player initializes credits, sets the wager, spins the reels, collects line pay awards, and, if a trigger symbol appears, also collects a Total Multiplier Bet award, as described in more detail below.

Referring now to the drawings, the player initializes credits by depositing money in the form of coins, gaming tokens or paper currency into a coin head 26 or bill acceptor 28. Coins and gaming tokens are collected in a reservoir (not shown) inside the gaming machine; paper currency is collected in the bill acceptor (not shown) inside the gaming machine.

If the coins, gaming tokens or paper currency are validated as authentic, the player accrues the appropriate number of playing credits on the credit meter or credit display 116. More credits may be initialized, if necessary, by additional deposits. Alternatively, any method of initializing credits may be used including debit cards, credit cards, smart cards, or other form of electronic funds transfer.

As seen in FIG. 1, the player sets the wager by selecting pay lines and setting the bet per pay line. The wager is calculated by multiplying the number of selected pay lines by the bet per pay line. For example, the player may wager five credits on each of nine pay lines for a total bet of forty-five credits. The total bet amount is displayed on the total bet meter/bet display 122.

To select pay lines, the player uses the Select Pay Lines button 108 and views the number of selected pay lines on the Select Pay Lines meter 118. Pay lines are selected in a predetermined order. For example, the first pay line selected is always pay line 1, second pay line selected is always pay line 2, etc. Alternatively, fewer or greater than nine pay lines may be used with any order of pay line activation.

To set the bet per pay line, the player uses the Bet Per Pay Line button 110 and views the amount bet per pay line on the Bet Per Pay Line meter 120. The same amount is wagered on each pay line. For example, up to five credits may be wagered on each pay line. Alternatively, wagers of any amount may be placed on a pay line, with the same or different amount wagered on each pay line.

In addition, the player may use the Bet Max button 112 to place the maximum bet per pay line on all pay lines. Alternatively, any predetermined wager may be assigned a button.

As illustrated in FIG. 1, in one embodiment, the Total Bet Multiplier value 168 appears above the symbol matrix 190. The Total Bet Multiplier value 168 equals the wager, as displayed in Total Bet meter 122. Alternatively, the Total Bet Multiplier value 168 may be determined by any function related to the wager. In particular, an alternative embodiment may increase the Total Bet Multiplier value 168 to a multiple of the wager at a predetermined wager level.

The player uses the Spin button 114 to cause a random rearrangement or generation of the symbols displayed in the symbol matrix 190. The symbol matrix 190 contains three symbol positions for each of the five slot reels 156, 158, 160, 162 and 164 for a total of fifteen symbol positions 126, 128, 130, 132, 134, 136, 138, 140, 142, 144, 146, 148, 150, 152, and 154. Alternatively, any suitable number of reels with any suitable number of symbol positions may be used.

The slot reels 156 to 164 spin and randomly stop. The symbols, however, are not instantly displayed in the symbol positions 126 to 154. Symbols appear one-at-a-time until all fifteen symbol positions 126 to 154 are revealed. Alternatively, any size symbol matrix may be used and any method may be used to rearrange symbols in the symbol matrix.

In one embodiment, line pay awards issue for winning symbol combinations formed by symbols appearing adjacently on a payline, starting from the leftmost position of a pay line. In FIG. 1, a winning D-D-D-D-D symbol combination 136 to 144 appears on a payline defined across the middle row 136 to 144 of the symbol matrix 190. The game calculates the value of the D-D-D-D-D symbol combination 136 to 144 by multiplying this symbol combination's award or value, as listed on a predetermined pay schedule or paytable (not shown), by the amount bet per pay line, as set by the Bet Per Pay Line button 110 and displayed on the Bet Per Pay Line meter 120.

In one embodiment, all line pays are defined on the pay schedule or paytable, with an award assigned to each listed line pay. In one of the Total Bet Multiplier embodiments, the pay schedule or paytable defines line pays as all combinations of three or more same symbols appearing adjacently on a payline, starting from left to right, and assigns a credit award for each such line pay. Alternatively, any number of line pays may be defined, with any award type and/or amount assigned to each line pay. The player may view the pay schedule by using the Pays button 104.

In one embodiment, the Total Bet Multiplier awards may issue when a trigger symbol ("TS") appears in the symbol matrix 190. The award is calculated by multiplying the highest line pay award by the Total Bet Multiplier value 168.

Figure 2:
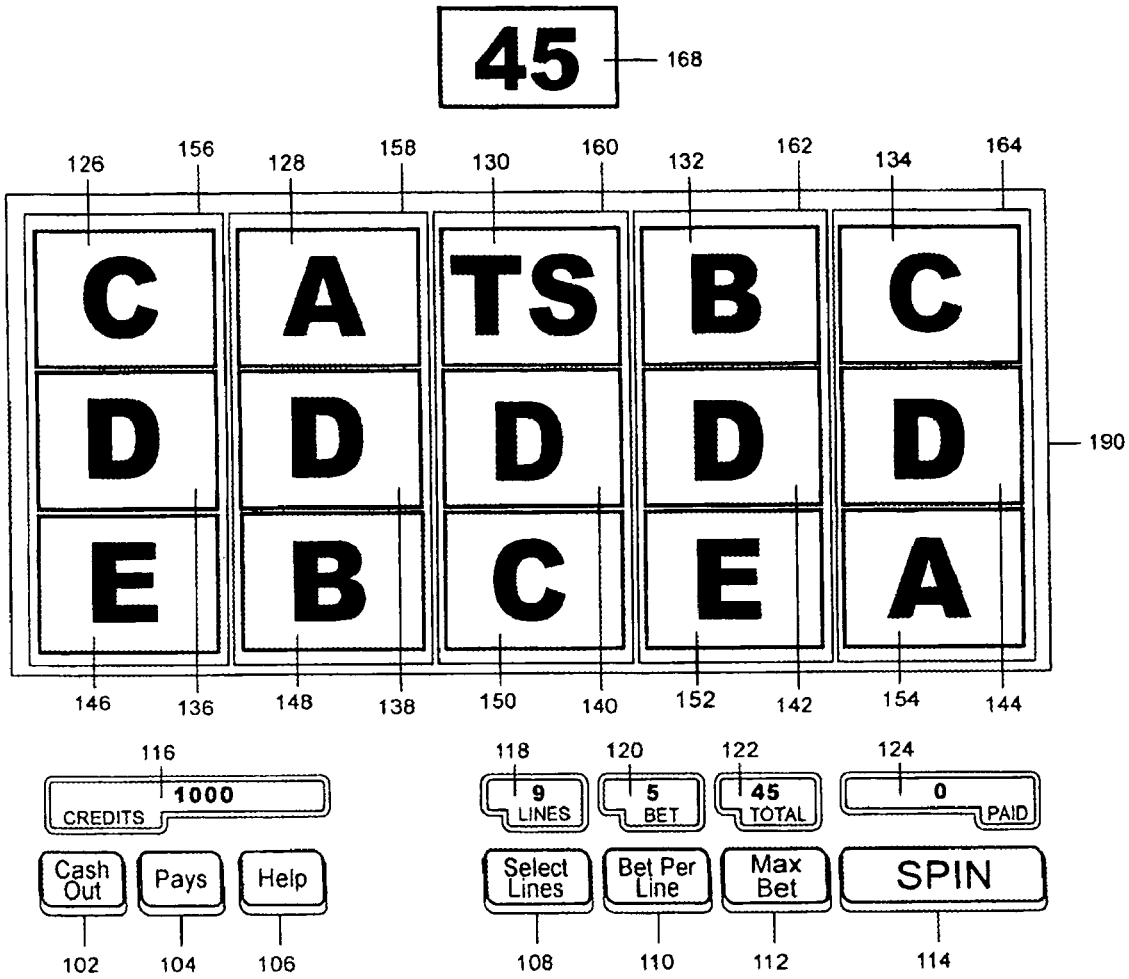
FIG. 2 is a elevation view of one of the display devices of the gaming device illustrating a total bet multiplier value above the symbol matrix, a trigger symbol on the third reel, and a winning symbol combination on a payline.

As seen in FIG. 2, a winning D-D-D-D-D symbol combination 136 to 144 appears on a payline defined across the middle row 136 to 144 of the symbol matrix 190 and a TS symbol appears in the top position 130 of the third reel 160 of symbol matrix 190. The TS symbol 130 triggers the Total Bet Multiplier award which the game calculates, as follows: first, the game determines that a winning D-D-D-D-D symbol combination appears in the symbol matrix 190; second, the game multiplies the value of the D-D-D-D-D symbol combination 136 to 144, as listed on a predetermined pay schedule (not shown), by the Total Bet Multiplier value 168; and third, the game issues the Total Bet Multiplier award to the player. The Total Bet Multiplier award is displayed in an award Paid meter 124.

In one embodiment, the Total Bet Multiplier award issues whether or not the player has placed a wager upon the payline 136 to 144 with the D-D-D-D-D symbol combination 136 to 144. If the player wagered upon the payline 136 to 144, the game issues the line pay award and the Total Bet Multiplier award for the D-D-D-D-D symbol combination 136 to 144. In one embodiment, if the player did not wager upon the payline 136 to 144, the game only issues the Total Bet Multiplier award for the D-D-D-D-D symbol combination 136 to 144.

Figure 3:
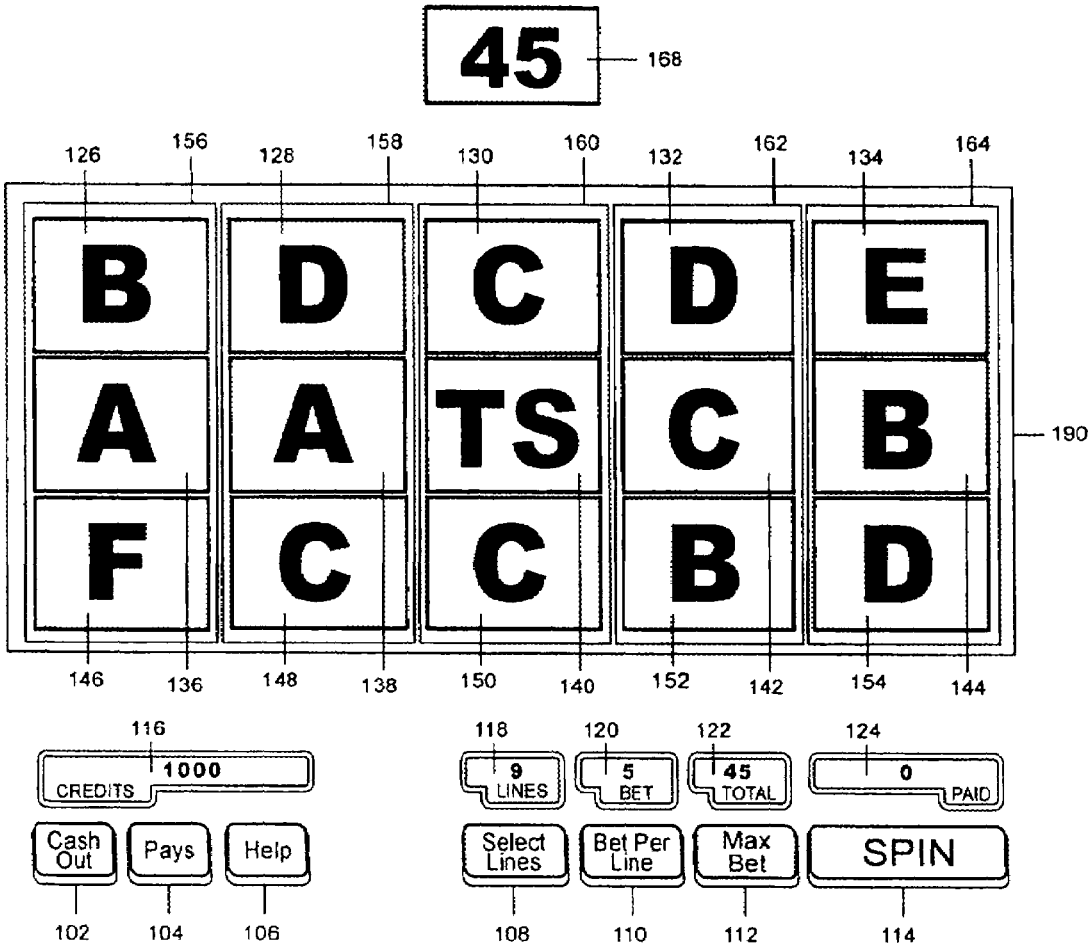
FIG. 3 is a elevation view of one of the display devices of the gaming device illustrating a total bet multiplier value above the symbol matrix, a trigger symbol on the third reel, and a winning symbol combination using the trigger symbol as a wildcard to help form a winning symbol combination on a payline.

As illustrated in FIG. 3, a winning A-A-TS symbol combination 136 to 140 appears on a payline defined across the middle row 136 to 144 of the symbol matrix 190. The TS symbol 140 is a wildcard and acts as an A symbol to help form a winning A-A-A symbol combination. The TS symbol 140 triggers the Total Bet Multiplier award which the game calculates, as follows: first, the game treats the TS wildcard symbol 140 as an A symbol to help form a winning A-A-A symbol combination 136 to 140 in symbol matrix 190; second, the game multiplies the value of the A-A-A symbol combination 136 to 140, as listed on a predetermined pay schedule (not shown), by the Total Bet Multiplier value 168; and third, the game issues the Total Bet Multiplier award to the player.

Figure 4:
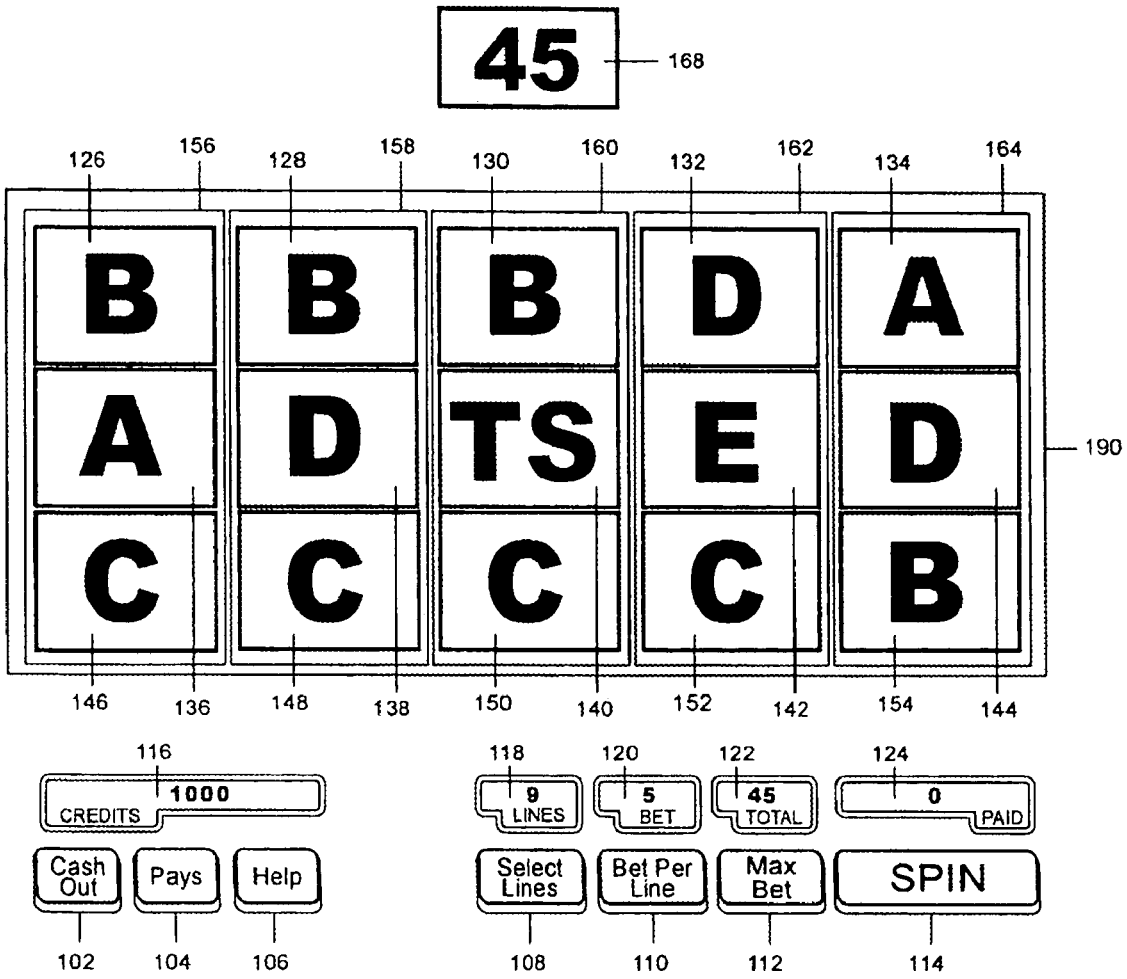
FIG. 4 is a elevation view of one of the display devices of the gaming device illustrating a total bet multiplier value above the symbol matrix, a trigger symbol on the third reel, and winning symbol combinations of differing values on two paylines.

As illustrated in FIG. 4, a winning B-B-B symbol combination 126-130 appears on a payline defined across the top row 126 to 134 and another winning C-C-C-C symbol combination 146 to 152 appears on a payline defined across the bottom row 146 to 154 of the symbol matrix 190. The TS symbol appears in the middle position 140 of the third reel 160 of symbol matrix 190. The TS symbol 140 triggers the Total Bet Multiplier award which the game calculates, as follows: first, the game determines that the B-B-B 126 to 130 and C-C-C-C 146 to 152 winning symbol combinations appear in the symbol matrix 190; second, the game determines that the C-C-C-C symbol combination 146 to 152 has the highest award value; third, the game multiplies the value of the C-C-C-C symbol combination 146 to 152, as listed on a predetermined pay schedule (not shown), by the Total Bet Multiplier value 168; and fourth, the game issues the Total Bet Multiplier award to the player.

Figure 5:
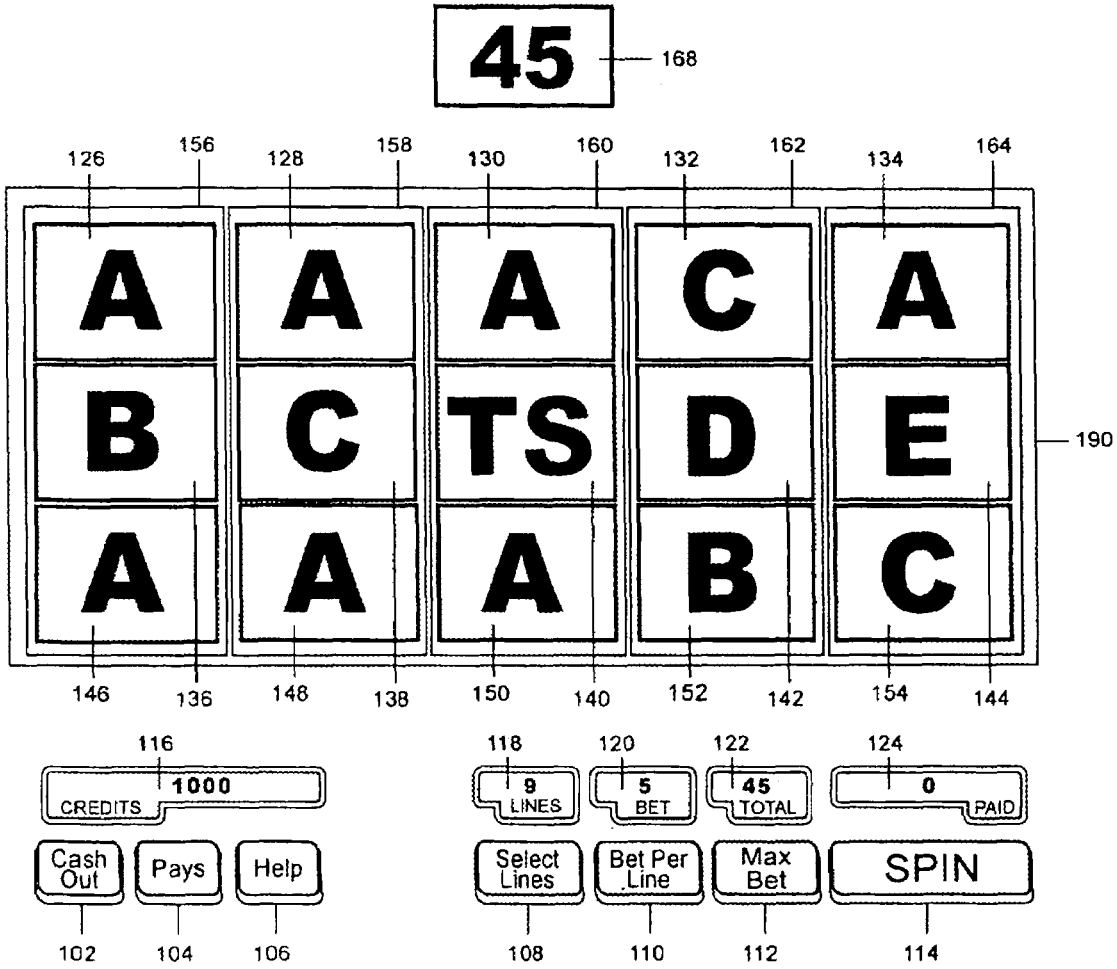
FIG. 5 is a elevation view of one of the display devices of the gaming device illustrating a total bet multiplier value above the symbol matrix, a trigger symbol on the third reel, and winning symbol combinations of the same value on two paylines.

In FIG. 5, a winning A-A-A symbol combination 126 to 130 appears on a payline defined across the top row 126 to 134 and another winning A-A-A symbol combination 146 to 150 appears on a payline defined across the bottom row 146 to 154 of the symbol matrix 190. The TS symbol appears in the middle position 140 of the third reel 160 of symbol matrix 190. The TS symbol 140 triggers the Total Bet Multiplier award which the game calculates, as follows: first, the game determines that the A-A-A 126 to 130 and A-A-A 146 to 150 winning symbol combinations appear in the symbol matrix 190; second, the game determines that these two symbol combinations are both the highest value awards and of equal values; third, the game multiplies the value of only one A-A-A symbol combination 126 to 130, as listed on a predetermined pay schedule (not shown), by the Total Bet Multiplier value 168; and fourth, the game issues the Total Bet Multiplier award to the player.

Following issuance of line pay and Total Bet Multiplier awards, the cumulative credits are added to the player's balance of credits. As long as the player has credits on the credit meter 116, the player may continue to play the gaming machine or the player may also collect the balance of credits by pressing the Cash Out button 102. In addition, the player may press the Help button 106 to view the rules of the game.

In one example, the gaming device provides a 9 payline game wherein the player can bet or wager from 1 to 5 credits per payline. In this example, the player may place a total wager of 1 to 45 credits and thus the Total Bet Multiplier value may range from 1 to 45, depending on the amount of the player's wager. In another example, the gaming device provides a 25 payline game wherein the player can bet or wager from 1 to 5 credits per payline. In this example, the player may place a total wager of 1 to 125 credits and thus the Total Bet Multiplier value may range from 1 to 125, depending on the amount of the player's wager. In one such example, if the player wagers 2 credits on each of the 25 paylines, the Total Bet Multiplier value is 50. It should be appreciated that in these embodiments, the total award provided to the player is based on the total wagers placed on all of the paylines and not just the wager placed on the payline which the winning symbol combination was generated on.

In one alternative embodiment, the present invention may use a symbol matrix of any size, such as a symbol matrix with 4 rows and 6 columns. In different embodiments, the size of the symbol matrix is predetermined, randomly determined, determined based on the player's wager, determined based on the player's status (such as determined through a player tracking system), determined based on time or determined based on any other suitable method.

In another embodiment, the present invention may use any number of paylines, such as 10, 25, 30 or 50 paylines. In different embodiments, the number of paylines is predetermined, randomly determined, determined based on the player's wager, determined based on the player's status (such as determined through a player tracking system), determined based on time or determined based on any other suitable method.

In another embodiment, the present invention may be triggered by any suitable event, such as an event based on one or more symbol combinations, an event based on the player's wager, a predetermined event, a randomly determined event, an event determined based on the player's status (such as determined through a player tracking system), or an event determined based on time.

In another embodiment, the present invention may calculate any number of line pay awards as a function of the total wager, such as the most valuable and least valuable line pay awards.

In another embodiment, the present invention may calculate line pay awards using any subset of symbols as a function of the total wager, such as only calculating awards for symbol combinations using "cherry" or other "fruit" symbols.

In another embodiment, the present invention may calculate line pay awards appearing on a subset of paylines as a function of the total wager, such as only calculating awards on odd paylines.

In another embodiment, the present invention may calculate line pay awards by multiplying a line pay award (PA) by the total bet (TS) plus a factor that remains constant across all game play options, outcomes, and events (CF), or PA*(TS+CF).

In another embodiment, the present invention may calculate line pay awards by multiplying a line pay award (PA) by the total bet (TS) plus a factor that varies in response to some or all game play options, outcomes, or events (VF), or PA*(TS+VF). In different embodiments, the varying factor is randomly determined, determined based on the player's wager, determined based on the player's status (such as determined through a player tracking system), determined based on time or determined based on any other suitable method.

In another embodiment, the present invention may calculate some line pay awards differently than others, such as multiplying a first line pay award (PA1) by the total bet (TS), or PA1*TS, and multiplying a second line pay award (PA2) by the total bet (TS) plus a constant factor (CF), PA2*(TS+CF). In different embodiments, the manner in which pay awards are calculated is predetermined, randomly determined, determined based on the player's wager, determined based on the player's status (such as determined through a player tracking system), determined based on time or determined based on any other suitable method.

In another embodiment, the present invention may be used as an optional game feature, such as a feature that is purchased with a supplemental wager by the player.

In another embodiment, the present invention may be used as a bonus game feature, such as a feature to a free-spin bonus game.

Figure 6A:
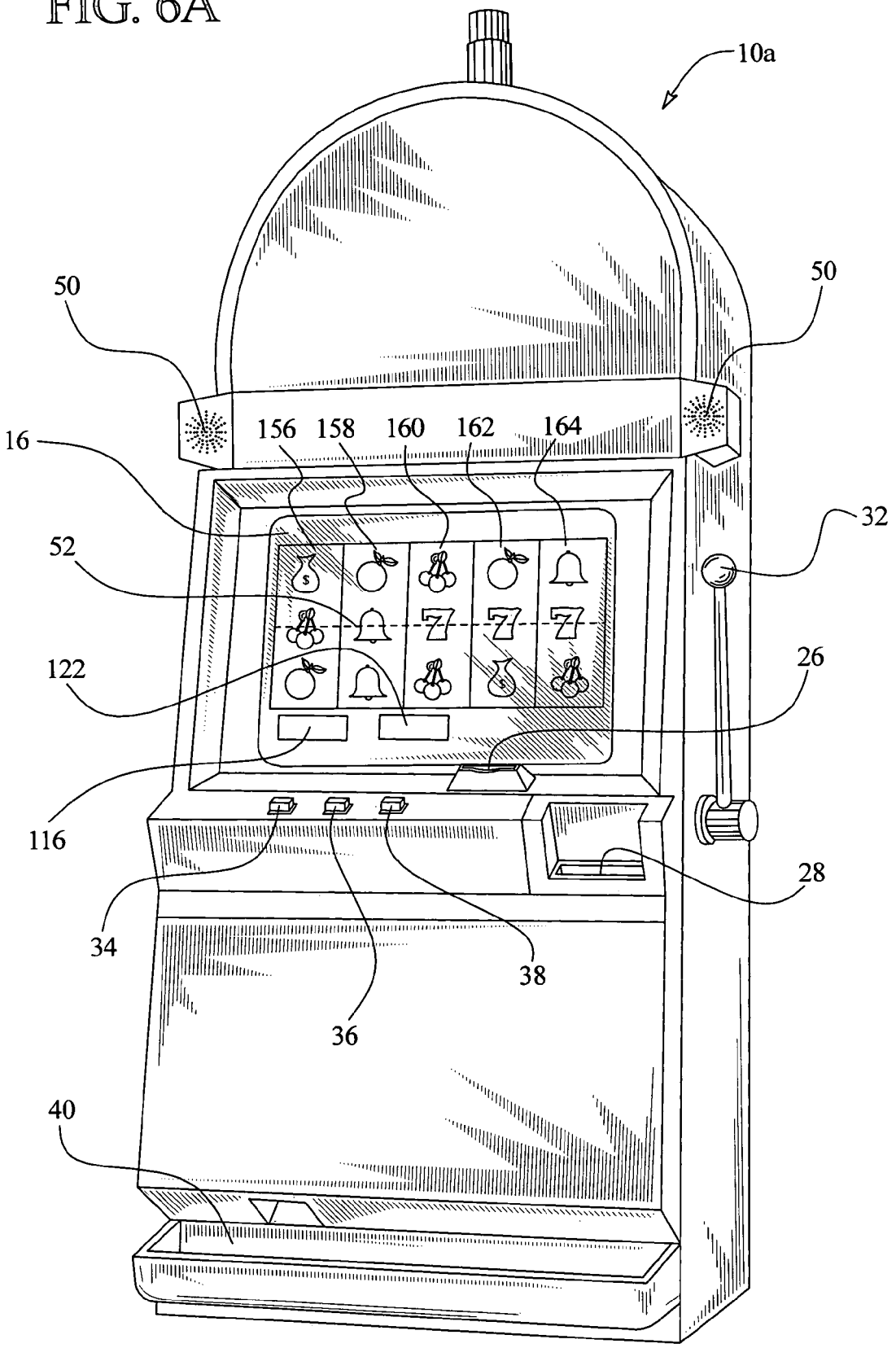
FIG. 6A is a front perspective view of one embodiment of the gaming device disclosed herein.
Figure 6B:
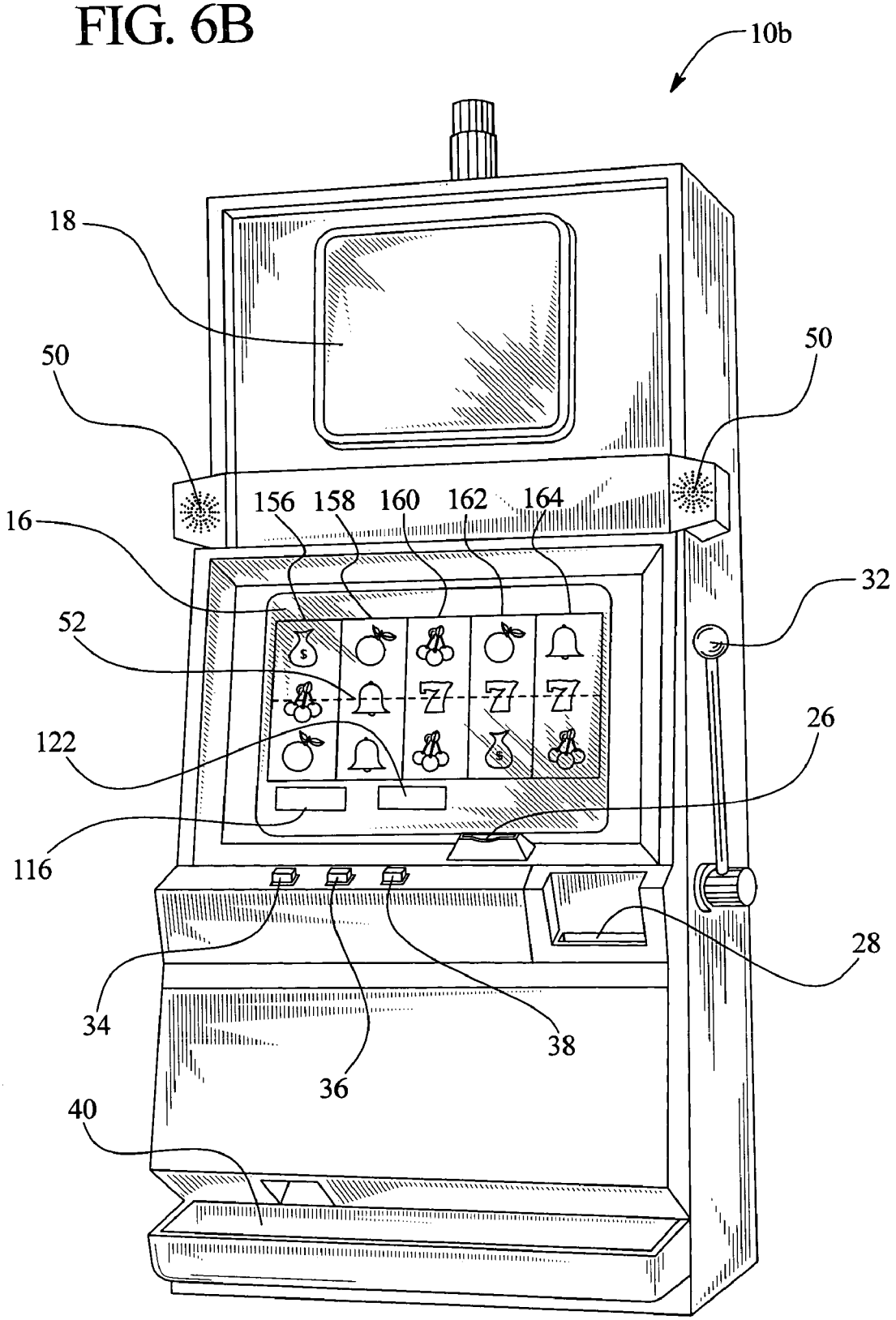
FIG. 6B is a front perspective view of another embodiment of the gaming device disclosed herein.

Two alternative embodiments of the gaming device are illustrated in FIGS. 6A and 6B as gaming device 10*a* and gaming device 10*b*, respectively. Gaming device 10*a* and/or gaming device 10*b* are generally referred to herein as gaming device 10.

In one embodiment, as illustrated in FIGS. 6A and 6B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 6A and 6B, the gaming device may have varying cabinet and display configurations.

Figure 7A:
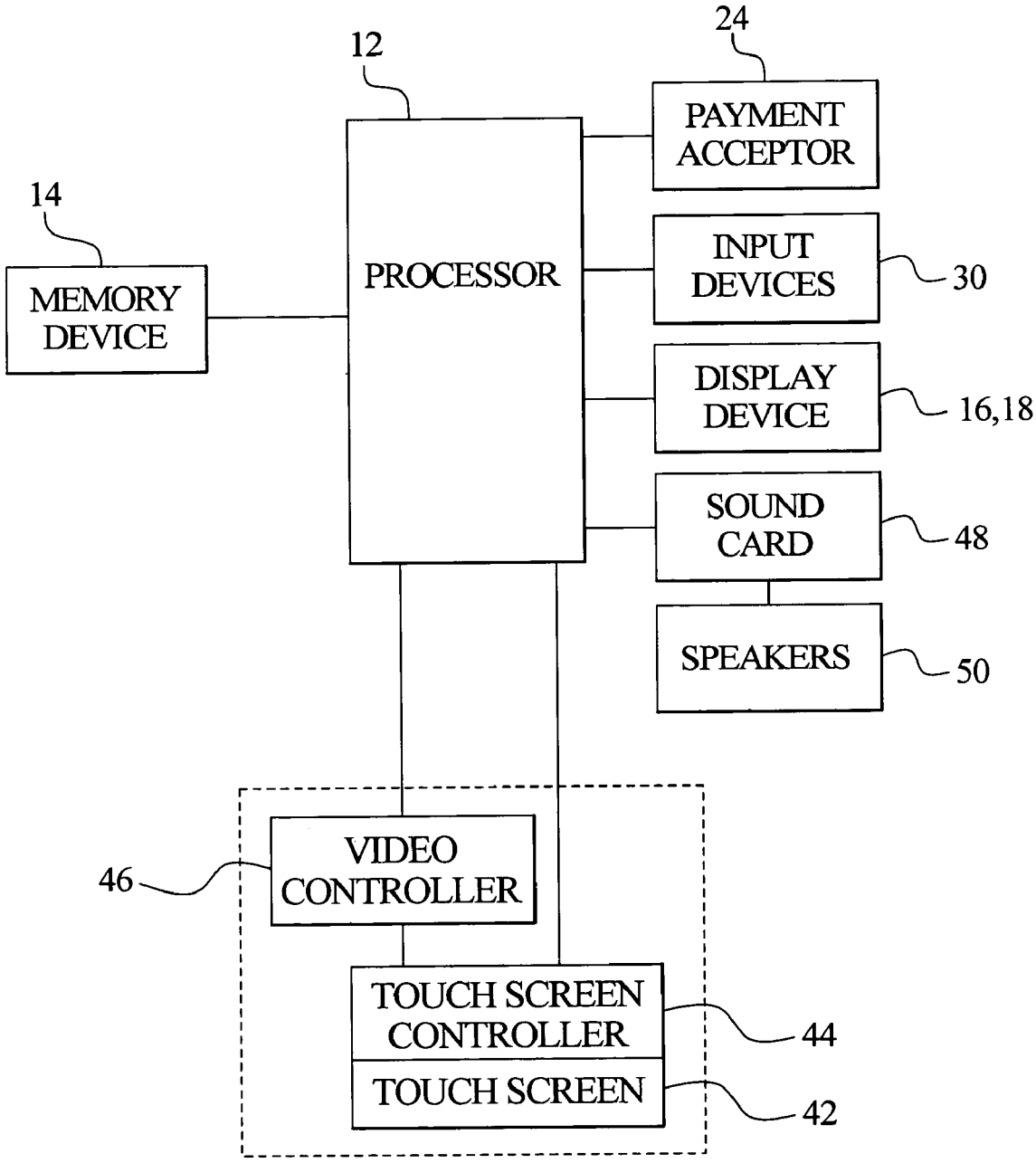
FIG. 7A is a schematic block diagram of one embodiment of an electronic configuration for one of the gaming devices disclosed herein.

In one embodiment, as illustrated in FIG. 7A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the art. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome. Such random determination could be provided through utilization of a random number generator (RNG) or other suitable randomization process.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses. In another embodiment, upon a player initiating game play at the gaming device, the gaming device enrolls in a bingo game. In this embodiment, a bingo server calls the bingo balls that result in a specific game outcome. The resultant game outcome is communicated to the individual gaming device to be provided to a player.

In one embodiment, as illustrated in FIG. 7A, the gaming device includes one or more display devices controlled by the processor. The display devices are preferably connected to or mounted to the cabinet of the gaming device. The embodiment shown in FIG. 6A includes a central display device 16 which displays a primary game. This display device may also display any secondary game associated with the primary game as well as information relating to the primary or secondary game. The alternative embodiment shown in FIG. 6B includes a central display device 16 and an upper display device 18. The upper display device may display the primary game, any suitable secondary game associated with the primary game and/or information relating to the primary or secondary game. In another embodiment, at least one display device may be a mobile display device, such as a PDA or tablet PC, that enables play of at least a portion of the primary or secondary game at a location remote from the gaming device. As seen in FIGS. 6A and 6B, in one embodiment, the gaming device includes a credit display 116 which displays a player's current number of credits, cash, account balance or the equivalent. In one embodiment, gaming device includes a total bet meter/bet display 122 which displays a player's amount wagered.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display including a projected and/or reflected image or any other suitable electronic device or display mechanism. In one embodiment, as described in more detail below, the display device includes a touch-screen with an associated touch-screen controller. The display devices may be of any suitable configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 7A, in one embodiment, the gaming device includes at least one payment acceptor 24 in communication with the processor. As seen in FIGS. 6A and 6B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and displays the corresponding amount on the credit or other suitable display as described above.

As seen in FIGS. 6A, 6B and 7A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 6A and 6B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 7A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 7A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video Keno, video bingo or any other suitable primary or base game may be implemented.

In one embodiment, as illustrated in FIGS. 6A and 6B, a base or primary game may be a slot game with one or more paylines 52. The paylines may be horizontal, vertical, circular, diagonal, angled or any combination thereof. In this embodiment, the gaming device displays at least one and preferably a plurality of reels 156 to 164, such as three to five reels in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels are in video form, one or more of the display devices, as described above, display the plurality of simulated video reels. Each reel displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active payline or otherwise occur in a winning pattern, occur on the requisite number of adjacent reels and/or occur in a scatter pay arrangement.

In one embodiment, a base or primary game may be a poker game wherein the gaming device enables the player to play a conventional game of video poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one and preferable a plurality of the selectable indicia or numbers via an input device or via the touch screen. The gaming device then displays a series of drawn numbers to determine an amount of matches, if any, between the player's selected numbers and the gaming device's drawn numbers. The player is provided an award based on the amount of matches, if any, based on the amount of determined matches.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 6A and 6B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game could be accomplished through a simple "buy in" by the player if, for example, the player has been unsuccessful at qualifying through other specified activities.

Figure 7B:
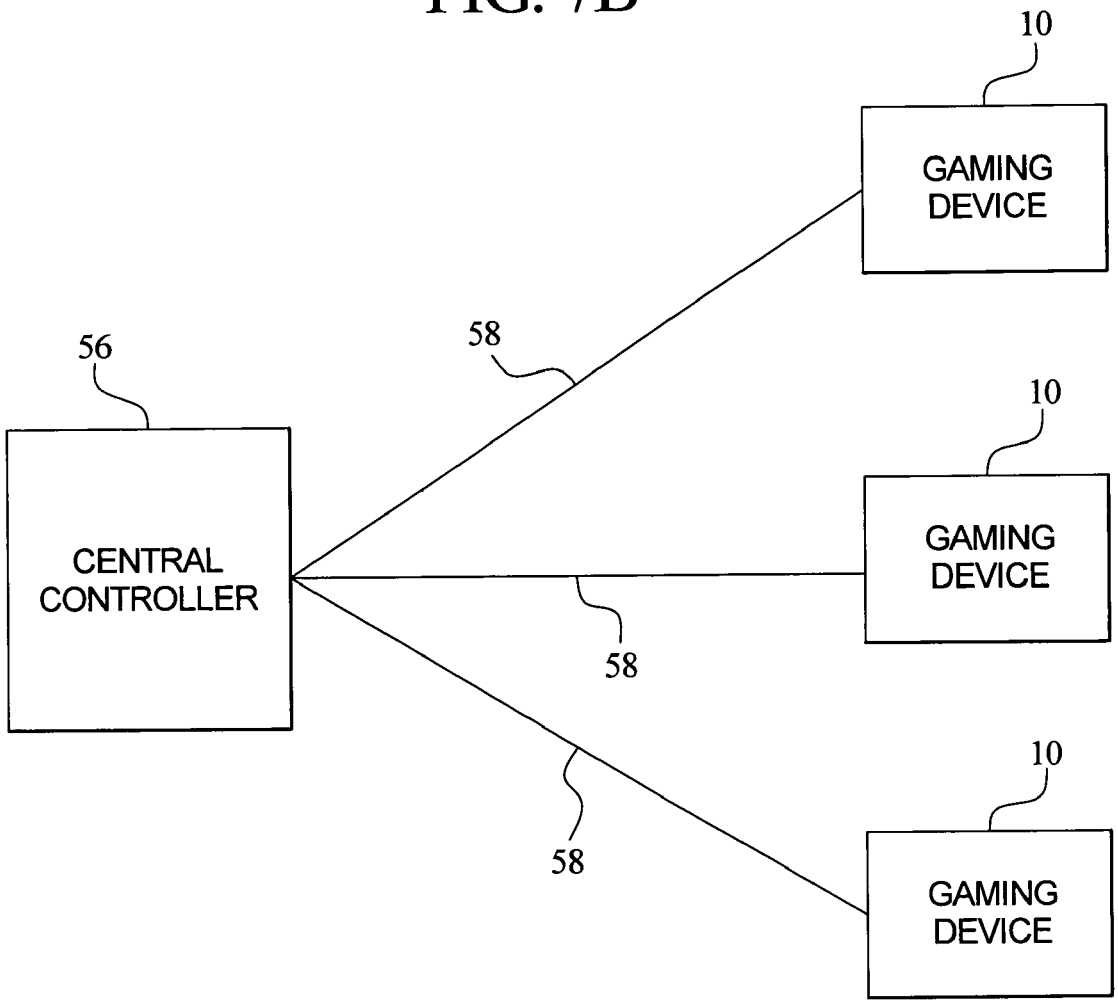
FIG. 7B is a schematic block diagram of one embodiment of a network configuration for a plurality of gaming devices disclosed herein.

In one embodiment, as illustrated in FIG. 7B, one or more of the gaming devices 10 may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo or keno game. In this embodiment, each individual gaming device utilizes one or more bingo or keno games to determine the predetermined game outcome value provided to the player for the interactive game played at that gaming device. In one embodiment, the bingo or keno game is displayed to the player. In another embodiment, the bingo or keno game is not displayed to the player, but the results of the bingo or keno game determine the predetermined game outcome value for the interactive game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a "daub" button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment insures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

In another embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a "chip" to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data, communication between the gaming device hardware and software and the host site computer. In one embodiment, an individual gaming machine may trigger a progressive win, for example through a game play event such as a symbol-driven trigger. In one embodiment, the central server or other central controller determines when a progressive win is triggered. In one embodiment, a central controller and an individual gaming machine work in conjunction with each other to determine when a progressive win is triggered, for example through an individual gaming machine meeting a predetermined requirement established by the central controller.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device, said gaming device comprising:

at least one display device;

at least one input device;

at least one processor; and at least one memory device storing a plurality of instructions which, when executed by the at least one processor, cause the at least one processor to operate with the at least one input device and the at least one display device for each of a plurality of plays of a game to:

(a) enable a player to participate in the game by for each of a plurality of paylines, placing a wager on said payline, wherein the sum of the wagers placed on the respective paylines equals a total wager;

(b) randomly generate and display a plurality of symbols at a plurality of symbol positions;

(c) determine if at least one winning symbol combination is generated;

(d) determine if a predetermined symbol is generated;

(e) if only one winning symbol combination is generated and the predetermined symbol is generated:

(i) determine a modified value by multiplying a value associated with the winning symbol combination by the total wager placed to participate in the respective play of the game, and (ii) provide the determined modified value to the player;

(f) if a plurality of winning symbol combinations are generated and the predetermined symbol is generated:

(i) determine a most valuable winning symbol combination appearing on any of the paylines, (ii) determine a modified value by multiplying a value associated with the determined most valuable winning symbol combination by the total wager placed to participate in the respective play of the game, and (iii) provide the determined modified value to the player; and (g) if at least one winning symbol combination is generated and the predetermined symbol is not generated, provide the player the value associated with the generated winning symbol combination.

2. The gaming device of claim 1, wherein the plurality of instructions, when executed by the at least one processor, cause the at least one processor to operate with the at least one input device and the at least one display device to if a plurality of winning symbol combinations are generated and the predetermined symbol is generated, provide the player the value associated with at least one of the generated winning symbol combinations other than the symbol combination determined to be the most valuable winning symbol combination.

3. The gaming device of claim 1, wherein the plurality of instructions, when executed by the at least one processor, cause the at least one processor to operate with the at least one input device and the at least one display device to:

if only one winning symbol combination is generated and the at least one predetermined symbol is generated, determine the modified value by multiplying the value associated with the winning symbol combination by the sum of: (a) the total wager placed to participate in the respective play of the game and (b) a factor, and provide the determined modified value to the player; and if the plurality of winning symbol combinations are generated and the predetermined symbol is generated, determine the most valuable winning symbol combination appearing on any of the paylines, determine the modified value by multiplying the value associated with the determined most valuable winning symbol combination by the sum of: (a) the total wager placed to participate in the respective play of the game and (b) the factor, and provide the determined modified value to the player.

4. The gaming device of claim 3, wherein the plurality of instructions, when executed by the at least one processor, cause the at least one processor to operate with the at least one input device and the at least one display device to vary the factor in response to at least one game event.

5. The gaming device of claim 3, wherein the plurality of instructions, when executed by the at least one processor, cause the at least one processor to operate with the at least one input device and the at least one display device to determine the factor in a manner selected from the group consisting of: (a) randomly, (b) based on the player's wager, (c) based on the player's status; and (d) based on a time.

6. A method of operating a gaming device, said method comprising:

(a) enabling a player to participate in a plurality of plays of a game by for each of the plurality of plays of the game, for each of a plurality of paylines, placing a wager on said payline, wherein the sum of the wagers placed on the respective paylines equals a total wager;

(b) randomly generating a plurality of symbols at a plurality of symbol positions;

(c) determining if at least one winning symbol combination is generated;

(d) determining if at least one predetermined symbol is generated;

(e) if only one winning symbol combination is generated and at least one predetermined symbol is generated:

(i) determining a modified value by multiplying a value associated with the winning symbol combination by the total wager placed to participate in the respective play of the game, and (ii) providing the determined modified value to the player;

(f) if a plurality of winning symbol combinations are generated and at least one predetermined symbol is generated:

(i) determining the most valuable winning symbol combination appearing on any of the paylines, (ii) determining a modified value by multiplying a value associated with the determined most valuable winning symbol combination by the total wager placed to participate in the respective play of the game, and (iii) providing the determined modified value to the player; and (g) if at least one winning symbol combination is generated and the predetermined symbol is not generated, providing the player the value associated with the generated winning symbol combination.

7. The method of claim 6, which includes if a plurality of winning symbol combinations are generated and the predetermined symbol is generated, providing the player the value associated with at least one of the generated winning symbol combinations other than the symbol combination determined to be the most valuable winning symbol combination.

8. The method of claim 6, which includes:

if only one winning symbol combination is generated and the at least one predetermined symbol is generated, determining the modified value by multiplying the value associated with the winning symbol combination by the sum of: (a) the total wager placed to participate in the play of the game and (b) a factor, and providing the determined modified value to the player; and if the plurality of winning symbol combinations are generated and the predetermined symbol is generated, determining the most valuable winning symbol combination appearing on any of the paylines, and determining the modified value by multiplying the value associated with the determined most valuable winning symbol combination by the sum of: (a) the total wager placed to participate in the play of the game and (b) the factor, and providing the determined modified value to the player.

9. The method of claim 8, which includes varying the factor in response to at least one game event.

10. The method of claim 8, which includes determining the factor in a manner selected from the group consisting of: (a) randomly, (b) based on the player's wager, (c) based on the player's status; and (d) based on a time.

11. A gaming device comprising:

at least one display device;

at least one input device;

at least one processor; and at least one memory device storing a plurality of instructions which, when executed by the at least one processor, cause the at least one processor to operate with the at least one input device and the at least one display device for each of a plurality of plays of a game to:

(a) enable a player to participate in the game by for each of a plurality of paylines, placing a wager on said payline, wherein the sum of the wagers placed on the respective paylines equals a total wager;

(b) randomly generate a plurality of the symbols at a plurality of symbol positions;

(c) determine if at least one winning symbol combination is generated;

(d) determine if a predetermined symbol is generated;

(e) if a plurality of winning symbol combinations are generated and the predetermined symbol is generated:

(i) determine a first modified value by multiplying a first value associated with a first winning symbol combination of the plurality of winning symbol combinations by the total wager placed to participate in the respective play of the game, (ii) determine a second modified value by multiplying a second value associated with a second winning symbol combination of the plurality of winning symbol combinations by the sum of: (a) the total wager placed to participate in the respective play of the game and (b) a factor, and (iii) provide the first determined modified value and the second determined modified value to the player; and (f) if at least one winning symbol combination is generated and the predetermined symbol is not generated, provide the player with the value associated with the generated winning symbol combination.

12. The gaming device of claim 11, wherein the plurality of instructions, when executed by the at least one processor, cause the at least one processor to operate with the at least one input device and the at least one display device to vary the factor in response to at least one game event.

13. The gaming device of claim 11, wherein the plurality of instructions, when executed by the at least one processor, cause the at least one processor to operate with the at least one input device and the at least one display device to determine the factor in a manner selected from the group consisting of: (a) randomly, (b) based on the player's total wager, (c) based on the player's status; and (d) based on a time.

* * * * *

UNITED STATES PATENT AND TRADEMARK OFFICE

CERTIFICATE OF CORRECTION

PATENT NO. : 7,674,174 B2
APPLICATION NO. : 11/253217
DATED : March 9, 2010
INVENTOR(S) : Marks et al.

It is certified that error appears in the above-identified patent and that said Letters Patent is hereby corrected as shown below:

In Claim 1, Column 17, line 5, replace "the sum of the wagers" with --a sum of the wagers--.

In Claim 3, Column 17, line 50, replace "symbol combination by the" with --symbol combination by a--.

In Claim 8, Column 18, line 55, replace "symbol combination by the" with --symbol combination by a--.

In Claim 11, Column 19, line 18, replace "the sum of the wagers" with --a sum of the wagers--.

In Claim 11, Column 20, line 7, replace "the sum of the wagers" with --a sum of the wagers--.

Signed and Sealed this

Thirteenth Day of July, 2010

David J. Kappos

David J. Kappos
*Director of the United States Patent and Trademark Office*